US005908184A

United States Patent [19]

Scoble

[11] Patent Number: 5,908,184

[45] Date of Patent: Jun. 1, 1999

[54] CLAMPING DEVICE INCLUDING BIASING MEANS AND A PAIR OF PLATES FOR HANGING ARTICLES THEREFROM

[76] Inventor: Greg Scoble, 203 The Circle Queen Elizabeth St., London, United Kingdom, SE12JN

[21] Appl. No.: 08/908,580

[22] Filed: Aug. 8, 1997

[51] Int. Cl.[6] ..... A47G 1/10

[52] U.S. Cl. ..... 248/316.3; 248/316.2

[58] Field of Search ..... 248/229.17, 228.8, 248/230.8, 316.1, 231.61, 227.2, 689, 693, 340, 316.2, 316.3; 24/16 R, 67 R

[56] References Cited

U.S. PATENT DOCUMENTS

| | | | |
|---|---|---|---|
| 749,834 | 1/1904 | Beisel | 24/16 R |
| 768,250 | 8/1904 | Walker | 24/131 R |
| 892,146 | 6/1908 | Flora | 217/68 |
| 1,003,108 | 9/1911 | Hinrichs | 410/41 |
| 2,266,181 | 12/1941 | Epps | 206/544 |
| 5,673,889 | 10/1997 | De Valcourt | 248/229.17 |

*Primary Examiner*—Ramon O. Ramirez
*Assistant Examiner*—Gwendolyn Baxter
*Attorney, Agent, or Firm*—Merek & Voorhees

[57] ABSTRACT

A clamping device for releasably hanging articles from an object. The device includes a pair of generally parallel plates having a pair of opposed and generally parallel side surfaces, biasing means to hold the plates together and to urge the opposed side surfaces toward one another, attachment means to secure the device to the object, and manually operable displacement means that, when engaged, overcomes the force of the biasing means and causes the plates to be displaced apart from one another so as to receive an article therebetween. When the manually operable displacement means is disengaged, the biasing means urges the plates toward one another such that the article is secured between the opposed side surfaces. The manually operable displacement means may be comprised of a pair of wedges positioned on opposite ends of the plates.

8 Claims, 4 Drawing Sheets

CLAMPING DEVICE INCLUDING BIASING MEANS AND A PAIR OF PLATES FOR HANGING ARTICLES THEREFROM

FIELD OF THE INVENTION

This invention relates to devices that may be used to hold, clamp and hang articles from a support member. In one particular embodiment and application the invention relates to a device that may be used to clamp and hang an article from a rope, wire, line or the like.

BACKGROUND OF THE INVENTION

A large number and variety of devices have been developed over time that are useful for holding or hanging articles from other objects or devices. Such prior devices include those that permanently clamp two articles together as well as those that releasably secure or hang one item from another. Such devices range in complexity from simple hooks to complex mechanical or electro-mechanical structures. Often the degree of complexity surrounding the device is related to the nature, including the weight, of the article being hung or supported and the particular environmental application for the device.

While the variety of such devices that have heretofore been created and put into use is reasonably broad, in many cases their function and application are hampered or limited. Accordingly, it will be appreciated that there continues to be a need for an easily operable clamping device or mechanism that can releasably secure one article or object to another.

SUMMARY OF THE INVENTION

The invention therefore provides a clamping device that is able to releasably secure or hang an article to a support member or from another object. The invention includes means to manually operate the device in order to both secure and release articles, and also includes attachment means allowing the device to be attached or fixed to the object or support member.

Accordingly, in one of its aspects the invention provides a clamping device for releasably hanging articles from an object, the device comprising a pair of generally parallel plate members having a pair of opposed and generally parallel side surfaces; biasing means to hold said plate members together and to urge said opposed side surfaces toward one another; attachment means to secure said device to the object; and, manually operable displacement means, said manually operable displacement means when engaged overcoming said biasing means and causing said plate members to be displaced apart from one another so as to receive an article therebetween, said manually operable displacement means when disengaged allowing said biasing means to urge said plate members toward one another such that the article is secured between said opposed side surfaces.

In a further aspect the manually operable displacement means comprises a pair of wedges, said wedges positioned on opposite ends of said plate members and being insertable between said opposed side surfaces of said plate members to displace said plate members apart from one another.

Further objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein.

Figure 2:
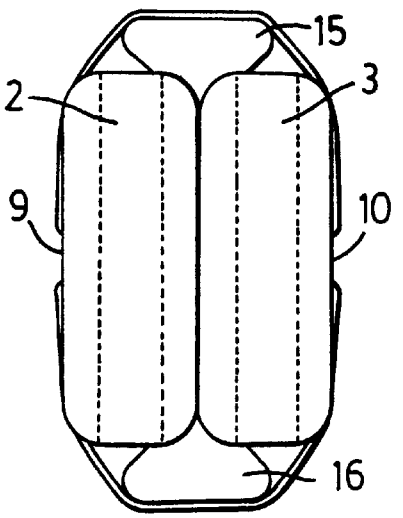
FIG. 2 is a side elevational view of the device shown in FIG. 1.
Figure 3:
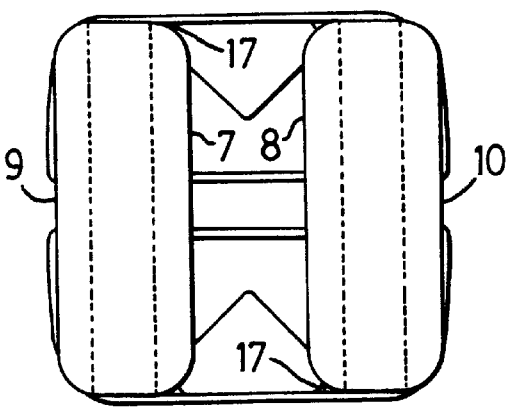
FIG. 3 is a side elevational view of the device shown in FIG. 2 in its open position.
Figure 1:
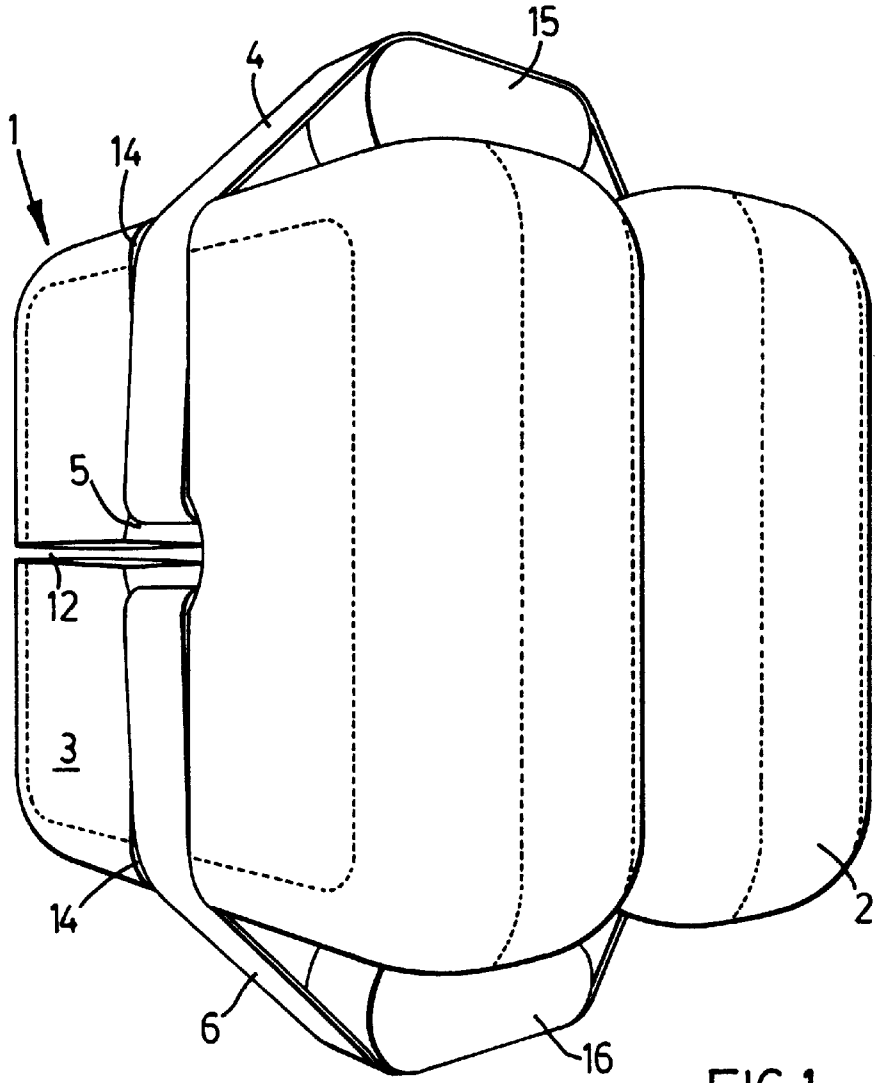
FIG. 1 is a side perspective view of the clamping device according to the present invention.
Figure 5:
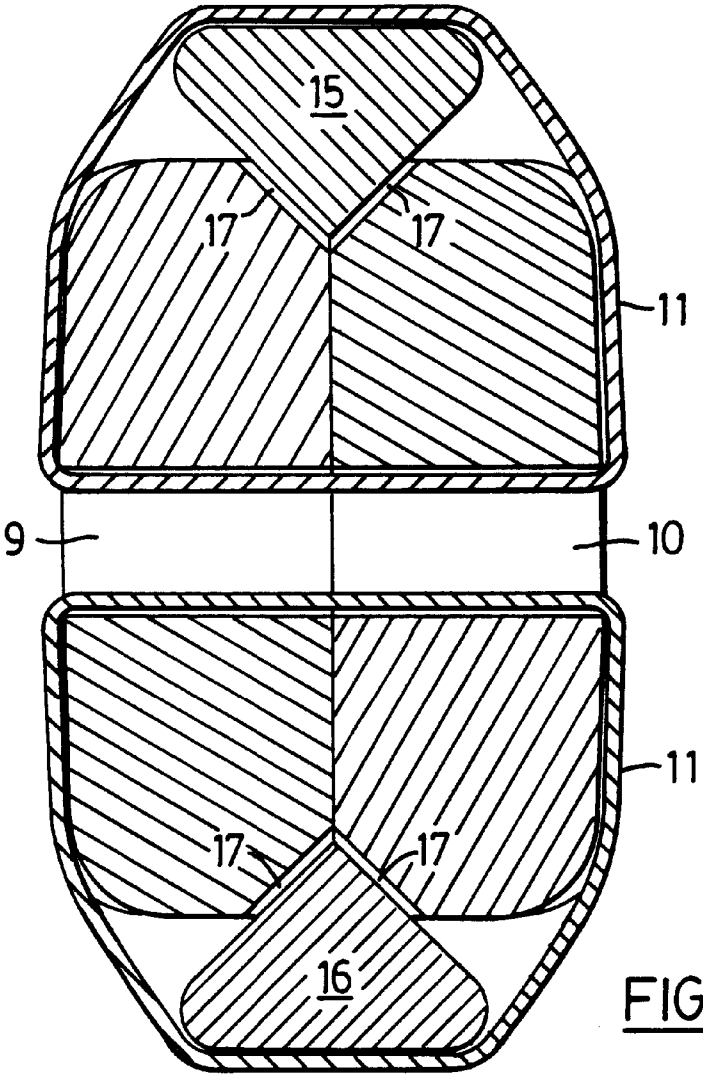
FIG. 5 is a sectional view taken along the line 5—5 of FIG. 4.

With reference to FIG. 1, the clamping device of the present invention is noted generally by the reference numeral 1. Clamping device 1 is comprised of a pair of plate members 2 and 3 that are situated adjacent and generally parallel to one another, biasing means 4, attachment means 5 and a manually operable displacement means 6. Plate members 2 and 3 have opposed side surfaces 7 and 8 that are positioned in a generally parallel relationship. As shown in the attached drawings plate members 2 and 3 are preferably planer in nature, however, it will be appreciated that their precise shape will not alter their function and usefulness, provided that opposed side surfaces 7 and 8 are generally parallel to one another. It will also be appreciated that while plate members 2 and 3 are shown to be generally square or rectangular they may be circular or any variety of other polygonal shape.

Biasing means 4 serves the function of holding plate members 2 and 3 together and urges opposed side surfaces 7 and 8 toward one another. As shown in FIGS. 1 through 4, in the preferred embodiment biasing means 4 comprises an elastomeric material that is wrapped around plate members 2 and 3 holding them together and pushing side surfaces 7 and 8 toward one another and into contact. Biasing means 4 may take the form of a variety of different structures. For example, biasing means 4 may be comprised of a single band of elastomeric material wrapped around plate members 2 and 3. Alternatively, biasing means 4 may comprise a plurality of such elastomeric bands.

In the preferred embodiment plate members 2 and 3 contain central bores, 9 and 10 respectively, that align when plate members 2 and 3 are adjacent to one another. Biasing means 4 are preferably comprised of circular bands 11 of elastomeric material that are able to pass though central bores 9 and 10 and around a portion of the exterior of each plate member. As is shown most clearly in FIGS. 1 through 4, bands 11 each pass through bores 9 and 10 and preferably pass around the exterior surfaces of opposite sides of plate members 2 and 3 to securely hold the plate members together. This structure has been found to be particularly advantageous as it provides a biasing means that securely and effectively holds plate members 2 and 3 together while at the same time providing a relatively simple structure that is easy to manufacture and assemble, and one that applies equal biasing force to opposite sides of plate members 2 and 3.

Bands of elastomeric material 11 may be linear pieces of elastomeric material that are first inserted through bores 9 and 10 and thereafter have their ends secured together through the use of one of a variety of different fasteners or fastening means. Alternately, and in the preferred embodiment, plate members 2 and 3 contain a laterally oriented slot 12 that passes from their exterior through to their central bore, thereby presenting a means to insert a pre-formed circular band into bores 9 and 10. That is, slots 12 allow for the use of pre-manufactured elastomeric bands and provide a quick and simple method to insert those bands into bores 9 and 10 and around the sides of the pate members. Bands 11 are preferably chosen such that once they are inserted into bores 9 and 10 and wrapped about the exterior surfaces of plates 2 and 3 they are stretched beyond their "at rest" positions. This will ensure that plates 2 and 3 are squeezed together such that sides surfaces 7 and 8 are also pressed or urged together. As is also shown in the attached drawings, and in particularly FIG. 3, slots 12 are preferably sufficiently large to allow for bands 11 to be inserted into bores 9 and 10, but also sufficiently small to prevent the accidental slippage of the bands back outwardly through the slots.

In order to help ensure that biasing means 4 holds plate members 2 and 3 together in a uniform and symmetrical manner, plate members 2 and 3 also contain grooves 14 on their exterior surfaces within which bands 11 are situated. Grooves 14 are preferably slightly wider than the width of bands 11 and comprise small generally rectangular channels within the exterior surfaces of plates 2 and 3. These channels help to prevent lateral movement or slippage of the bands about the surface of the plate members. In this fashion bands 11, once positioned in place, will be held securely on opposite sides of plate members 2 and 3 and exert a uniform and symmetrical biasing force against the plates.

Figure 6:
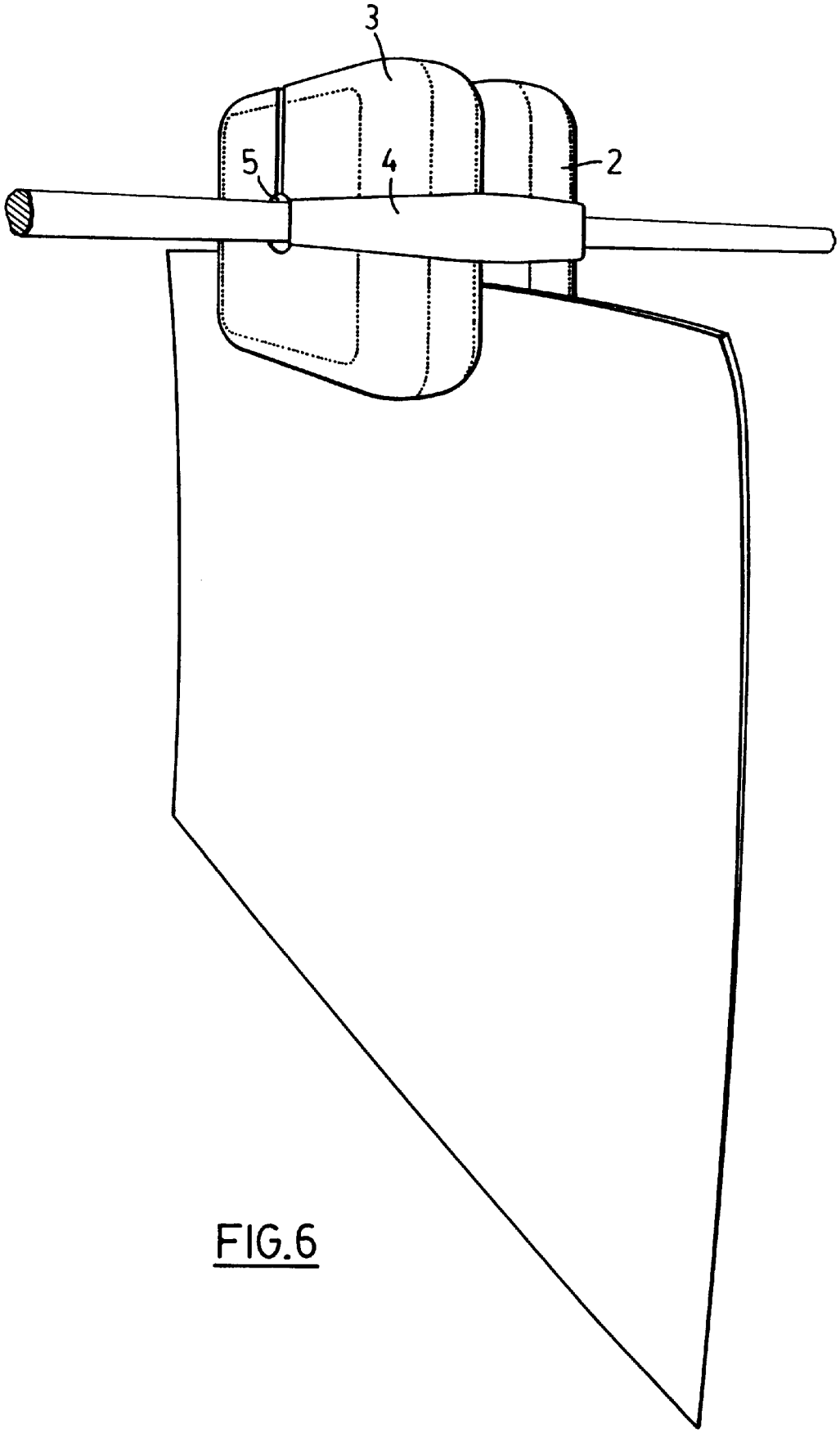
FIG. 6 is a side perspective view of the device of the present invention as shown in operation releasably hanging an article from a support member; and, FIG. 7 is an alternate embodiment of the device shown in FIG. 5.
Figure 7:
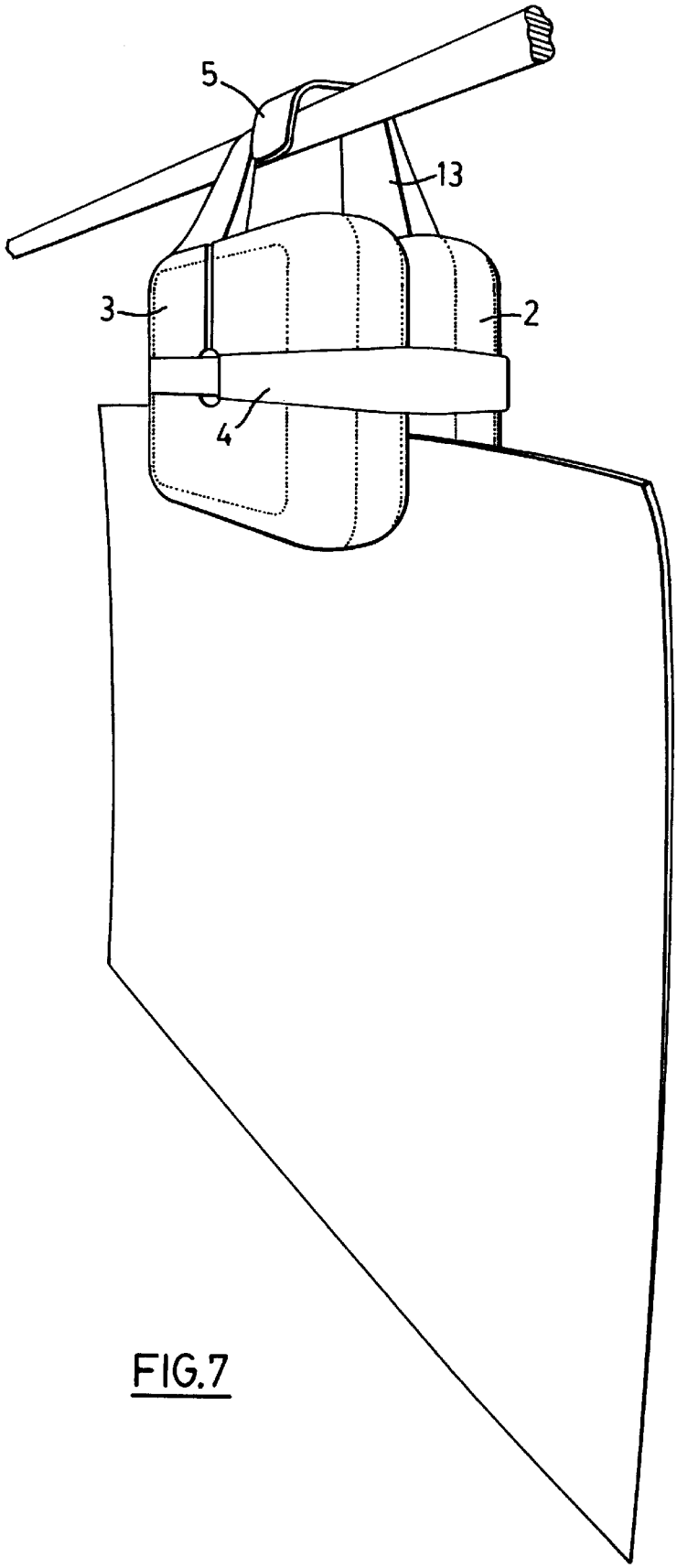

Central bores 9 and 10 may also function as attachment means 5 and provide a mechanism and structure to allow device 1 to be releasably secured or hung from a support member. For example, device 1 may be hung from a nail or post by inserting the nail or post into bores 9 and 10. Similarly, device 1 may be hung from a rope, wire or line by merely inserting the rope, wire or line through bores 9 and 10 and suspending device 1 therefrom (see FIG. 6). If desired, a number of clamping devices may be supported on a single rope, wire or line in this manner. In an alternate embodiment attachment means 5 may comprise a single hook connected to one of plate members 2 or 3. In yet a further embodiment (and as shown in FIG. 7) attachment means 5 comprises a pair of hook members 13 separately attached to plates 2 and 3. Through this structure device 1 may be secured to another object, support member, or line by means of hook members 13.

Referring again to FIGS. 1 through 4, in the preferred embodiment manually operable displacement means 6 provides a means to operably overcome the biasing force applied by biasing means 4 thereby allowing plate members 2 and 3 to be displaced apart from one another. Once plate members 2 and 3 are displaced an article may be received between opposed side surfaces 7 and 8. When manually operable displacement means 6 is disengaged biasing means 4 will urge plate members 2 and 3 back toward one another such that the article is secured between surfaces 7 and 8. If desired a friction enhancer may be imparted on opposed side surfaces 7 and 8 to increase their gripping effect. Such friction enhancers may include the use of laterally arranged grooves or ridges, or the application of a relatively high friction layer of material, such as rubber.

Figure 4:
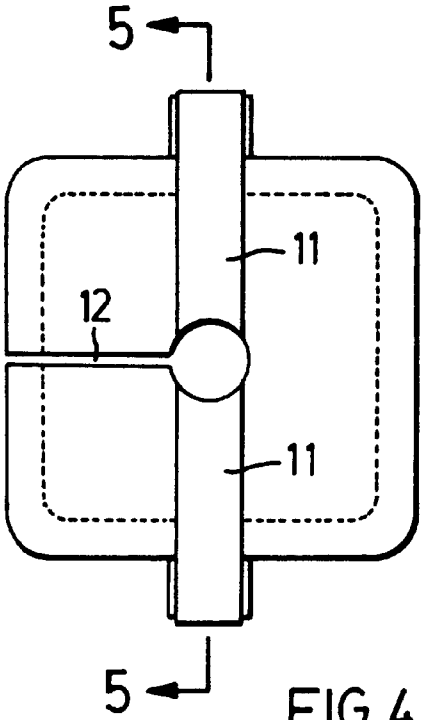
FIG. 4 is a front view of the device shown in FIG. 1.

Manually operable displacement means 6 preferably comprises a pair of wedges 15 and 16 positioned on opposite sides of plate members 2 and 3. Wedges 15 and 16 are positioned such that they point inwardly toward the centre of device 1. It will be appreciated that in this way if the wedges are manually inserted between opposed side surfaces 7 and 8 they will displace or drive plate members 2 and 3 apart. As shown in FIG. 4, inserting or pushing wedges 15 and 16 between opposed side surfaces 7 and 8 causes a lateral displacement of plate members 2 and 3 and effectively "opens" clamping device 1. Once "opened" it then becomes a simple task to insert an article between the opposed side surfaces. Preferably wedges 15 and 16 are positioned such that bands 11 encompass them with the bands being wrapped around the outer edges of the wedges. Through use of an adhesive or other fastening device or mechanism the outer edges of the wedges are attached to the bands. This will ensure that when released the wedges remain secured in place and are not separated from the remaining parts of clamping device 1.

Wedges 15 and 16 are generally triangular in shape and both are of approximately the same size. It will thus be appreciated that as the wedges are driven inwardly between opposed side surfaces 7 and 8 they will tend to uniformly displace the plate members apart, maintaining the generally parallel relationship of the side surfaces. Similarly, the shape of the wedges, together with the uniform nature of the compressive force applied to plate members 2 and 3 by biasing means 4, will result in the wedges being driven outwardly by the plate members through the application of the biasing force. That is, the particular structure of the invention is such that when wedges 15 and 16 are released, bands 11 will tend to not only urge and drive plates 2 and 3 toward one another but will also result in wedges 15 and 16 being driven outwardly from between opposed side surfaces 7 and 8.

Plate members 2 and 3 also preferably include guide slots 17 that help to maintain the positioning of wedges 15 and 16, in a similar manner as grooves 14 help to maintain the position of bands 11. Guide slots 17 are of a generally rectangular shape and slightly wider than the width of the wedges 15 and 16 such that the sides of the wedges may be received within the guide slots. Slots 17 will thus provide a structure that will help maintain the position of the wedges and also help to direct the wedges between side surfaces 7 and 8 when external force is applied to them.

Through the above described structure, releasably securing or hanging an article from another object or support member will simply require applying pressure to the outer edges of wedges 15 and 16 in order to drive them inwardly between opposed side surfaces 7 and 8 and thereby displace the side surfaces apart from one another. At that point an article may be inserted between the side surfaces such that removing the application of force from the outer edges of the wedges allows the elastomeric bands to effectively "close" the device through driving or urging side surfaces 7 and 8 toward one another. The article will then be held between the side surfaces. Similarly, a subsequent application of force against the outer edges of wedges 15 and 16 will enable the clamping device to be opened such that the article can be removed. Device 1 may be attached to another object or support member through the use of central bores 9 and 10, or through hook members 13 in an alternate embodiment.

It will be appreciated that depending upon the size and relative elasticity of bands 11, a variety of different articles may be held, hung or suspended from another object by clamping device 1. For example, clamping device 1 may be used to hang or suspend photographic film or prints from a line in a dark room, may be used to suspend clothing from a drying line or rack, may be used as a means to hang or display clothing in retail environments, or may be used in a wide variety of applications of both a commercial and residential nature.

It is to be understood that what has been described are the preferred embodiments of the invention and that it may be possible to make variations to these embodiments while staying within the broad scope of the invention. Some of these variations have been discussed while others will be readily apparent to those skilled in the art.

I claim:

1. A clamping device for releasably hanging articles from an object, the device comprising:

a pair of generally parallel plate members having a pair of opposed and generally parallel side surfaces;

biasing means to hold said plate members together and to urge said opposed side surfaces toward one another;

attachment means for securing said device to the object; and, manually operable displacement means, said manually operable displacement means when engaged overcoming said biasing means and causing said plate members to be displaced apart from one another so as to receive an article therebetween, said manually operable displacement means when disengaged allowing said biasing means to urge said plate members toward one another such that the article is secured between said opposed side surfaces, said manually operable displacement means comprising a pair of wedges, said wedges positioned on opposite ends of said plate members and being insertable between said opposed side surfaces of said plate members to displace said plate members apart from one another.

2. The device as claimed in claim 1 wherein said biasing means comprises an elastomeric material wrapped around said pair of plate members.

3. The device as claimed in claim 2 wherein said wedges are attached to said biasing means.

4. The device as claimed in claim 3 wherein said pair of plate members include guide slots, said guide slots helping to maintain and direct said wedges between said opposed side surfaces when said wedges are inserted between said side surfaces.

5. The device as claimed in claim 4 wherein said plate members contain a central bore, said biasing means comprising a pair of circular bands of said elastomeric material that pass through said central bore of said plate members and thereby hold said plate members together.

6. The device as claimed in claim 5 wherein said plate members include grooves on their exterior surfaces, said circular bands of elastomeric material engaging said grooves to help prevent slippage of said bands about the surface of said plate members.

7. The device as claimed in claim 6 wherein said attachment means comprises said central bores through said plate members, said central bores receivable on a rope, wire or line to attach said device thereto.

8. The device as claimed in claim 6 wherein said attachment means comprises at least one hook member connected to said plate members.

* * * * *